US005468200A

United States Patent [19]

Hoffman

[11] Patent Number: 5,468,200

[45] **Date of Patent: * Nov. 21, 1995**

[54] WEIGHTED EXERCISE GLOVE HAVING WEBBED FINGERS

[75] Inventor: Ned Hoffman, Berkeley, Calif.

[73] Assignee: Sports-Mitt International, Berkeley, Calif.

[ * ] Notice: The portion of the term of this patent subsequent to Apr. 2, 2008, has been disclaimed.

[21] Appl. No.: 669,177

[22] Filed: Mar. 14, 1991

Related U.S. Application Data

[63] Continuation-in-part of Ser. No. 398,360, Aug. 25, 1989, Pat. No. 5,004,227, which is a continuation-in-part of Ser. No. 289,191, Dec. 23, 1988, Pat. No. 4,923,418.

[51] Int. Cl.[6] ..... A63B 31/04

[52] U.S. Cl. ..... 482/55; 482/105

[58] Field of Search ..... 482/44, 47, 48, 482/55, 93, 105, 139; 441/56, 57, 58; 273/54 B; 2/19, 159, 161 R, 161 A, 163

[56] References Cited

U.S. PATENT DOCUMENTS

| | | | |
|---|---|---|---|
| 2,725,561 | 12/1955 | Blepp | 2/19 |
| 3,098,234 | 7/1963 | Latina | 2/19 |
| 3,203,006 | 8/1965 | Shirey | 482/105 X |
| 4,247,097 | 1/1981 | Schwartz | 272/117 |
| 4,253,660 | 3/1981 | Tiktin | 482/105 X |
| 4,258,914 | 3/1981 | Lalli | 272/71 |
| 4,279,681 | 7/1981 | Klimezky | 3/19 X |
| 4,326,706 | 4/1982 | Guthrie et al. | 272/119 |
| 4,330,120 | 5/1982 | Netti | 272/119 |
| 4,345,335 | 8/1982 | Shih-Li | 2/161 A |
| 4,366,580 | 1/1983 | Zidele | 2/19 |
| 4,368,883 | 1/1983 | Tiktin | 482/105 X |
| 4,371,983 | 2/1983 | Piotti, Jr. | 272/119 X |
| 4,561,122 | 12/1985 | Stanley et al. | 2/161 A X |
| 4,684,123 | 8/1987 | Fabry | 272/119 |
| 4,809,366 | 3/1989 | Pratt | 2/161 A X |
| 4,923,418 | 5/1990 | Hoffman | 482/105 X |
| 4,964,174 | 10/1990 | Martin | 2/163 X |
| 5,004,227 | 4/1991 | Hoffman | 482/105 |

*Primary Examiner*—Richard J. Apley
*Assistant Examiner*—John Mulcahy

[57] ABSTRACT

An exercise apparatus (302) for strapping weights (8) to a user's hand (1). The exercise apparatus may be used in water for swimming or on land for jogging or other exercise. A weight is inserted into a pocket (6) on a support (3) for placement on the backhand portion (14) of the user's hand. A strap (310) is mounted across the pocket to retain the weight in position. The strap includes a first band (332) having free ends (334, 336) for wrapping around the user's metacarpus. An auxiliary band (342) extends at an angle from the first band toward and around the inside of the user's wrist. The weight is removable from the pocket to permit variability of the amount of weight carried in proportion to desired muscle stress. The exercise apparatus may include a plurality of pockets for insertion of a plurality of weights. Adjacent fingers (318) are connected by webbing (370).

9 Claims, 7 Drawing Sheets

WEIGHTED EXERCISE GLOVE HAVING WEBBED FINGERS

This is a continuation in part of application Ser. No. 07/398,360 filed Aug. 25, 1989, now U.S. Pat. No. 5,004, 227, which was a continuation in part of application Ser. No. 07/289,191 filed Dec. 23, 1988, now U.S. Pat. No. 4,923, 418.

This invention relates to apparatus for enhancing beneficial muscle stress and aerobic capacity during exercise.

BACKGROUND OF THE INVENTION

Athletes often attempt to maximize the benefit of various physical activities by using equipment specially designed to increase speed and efficiency of muscle and aerobic workout.

Swimmers may wear gloves during exercise which have webs formed between adjacent fingers. Webs increase resistance to water, thus increasing aerobic efficiency and speed of the swimmer. It has been appreciated that in order to maximize speed during swimming, it is necessary to minimize weight, maximize buoyancy and maximize the proportion of the swimmer's body in air to the proportion of the swimmer's body in water. It is desired to maximize the proportion of the swimmer's body in air to water because air is a less dense medium than water, allowing less resistance to movement in the less dense medium. Thus, greater swimming speed is achieved by the swimmer where buoyancy is maximized. In the process of achieving greater speed and buoyancy, the swimmer using a webbed glove encounters greater resistance in the portion of the water in which his body is still immersed. Therefore, the swimmer achieves greater swimming speed and greater exercise efficiency through his increased muscle exertion.

Unlike swimmers, joggers may choose to carry an object, such as a weight, while running. U.S. Pat. No. 4,326,706 to Guthrie et al. relates to a jogging glove for carrying two weights: a first weight disposed on the palm side of the hand and a second weight disposed on the back side of the hand. The total weight carried by the glove may be varied by changing only the palm weight. In theory, the weight on the back of the hand is permanently bound into the glove to avoid misshaping and bulging of the metacarpal area on the back hand of the glove and to avoid interference with normal movement of the user's wrist.

In practice, the prior art leaves weights to shift in arbitrary manners and so can cause discomfort and irritation to the metacarpal bones and tendons of the back of the hand. Also, permanent backhand weights limit the function of prior art as weights cannot be significantly varied to accommodate different levels of fitness and arm motions in various sports.

SUMMARY OF THE INVENTION

The present invention relates to an exercise apparatus for enhancing muscle stress and aerobic benefit during exercise in water or on land. Weights are held against the back of the athlete's hands. The configuration of the present invention optimizes hand muscle group movement, minimizes the restriction of blood flow, and effectively restricts movement of the weights in any direction.

The apparatus of the present invention includes a first surface having a pocket for receiving a removable weight. A strap overlies the pocket and securely holds the weight within the pocket, specifically to ensure no metacarpal or backhand tendon irritation or swelling, as all backhand weights are comfortably secured directly to the hand. The strap effectively functions to directly oppose gravitational forces which otherwise would constantly act to shift the weights counter to any movement of the hand. The strap also firmly maintains the support and entire exercise apparatus on the user's backhand.

The strap preferably includes a first band having first and second free ends which extend around the user's hand such that the first free end wraps around the metacarpal bone of the little finger. The second free end wraps between the metacarpal bones of the index finger and thumb. The free ends converge at the palm of the user's hand and are fastened together by a hook and loop fastener of the type commonly known as Velcro®. An auxiliary band is connected to the first band and extends at an angle therefrom, away from the user's fingers, toward and encircling the user's wrist. The auxiliary band is configured to extend across the backhand portion, around the user's wrist, below the opponens pollicis muscle of the user's thumb. A patch is secured to the end of the auxiliary band near the thumb, which is securable to the first band, preferably by Velcro®. The strap may be permanently affixed to the backhand portion of the exercise apparatus or may be removable therefrom.

For the purposes of this discussion, assume the first band is laid flat in a plane and is attached to and extends across the top of the weight pockets. The ends of the first band would actually wrap around and secure in the palm of the hand when the product is in use, but for the purposes of this discussion the first band is laid flat in one plane. The first band ensures no movement of the weights either perpendicular to the plane of the strap or parallel to the strap within the plane of the strap. Having the auxiliary strap described above provides that there be no movement of the weights in any direction perpendicular to the first band within the plane of the first band.

In one form of the invention, the auxiliary band may include a pad on its underside at the location of the user's wrist. The pad ensures maximum comfort by decreasing the force pressure operating against the palmaris longus tendon.

The exercise apparatus may be in the form of a glove including a mitt having a backhand portion and a palm portion. A plurality of finger sleeves are integrally formed with the mitt. The glove preferably includes Velcro® mounted on the palm portion for securing the free ends of the first band to the palm portion of the glove, as well as to each other. Alternately, the apparatus may include only a support having a first surface for mounting on the user's backhand. In either embodiment, the pocket is formed on the backhand of the apparatus. A strap is adapted to secure the weight to the user's hand.

In the preferred embodiment, a reinforcing strip is positioned on the interior surface of the pocket for securing the weight in place.

Weights are removable from the pockets so as to permit adjustability. The user may change the amount of weight carried during a particular activity, thereby varying muscle and aerobic stress. Alternately, the user may vary the amount of weight for different activities.

In one form of the invention specially designed for swimming, the finger sleeves are connected by webbing. The webbing need extend only to a point below the distal phalange of the user's fingers, increasing resistance to water, and, thus, efficiency and speed of the swimmer, although the webbing may also extend to the distal end of the distal phalanges. In this embodiment the backhand portion of the mitt includes a pocket for receiving one or more weights.

The pocket is disposed to position the weight against the back of the user's hand. The weight may be held in position with or without a strap. Where no strap is used, the mitt may formed of a stretchable material sized such that the stretched material holds the weight against the hand. The weight pocket may be formed either to open into or outward of the mitt interior.

In alternate embodiments for swimming and jogging, adjacent finger sleeves are connected by loops for removal of the glove. The loops are disposed in the vicinity of the proximal phalanges of two adjacent finger sleeves. The user may insert his or her fingers of the opposite hand into the loops and pull outwardly away from the palm wearing the glove for facilitating removal of the glove from the user's hand.

While running, it is often desirable to conform the fingers about an object, such as a weight. A pocket may be formed on the palm portion of the mitt for receiving such an object so as to allow the fingers to comfortably conform about it in such a manner.

As discussed with reference to conventional swimming gloves, in order to maximize speed during swimming, it is desirable to minimize weight, maximize buoyancy and maximize the proportion of the swimmer's body in air to the proportion of the swimmer's body in water. Thus, the use of weights while swimming appears contrary to achieving greater speed and efficiency. However, the combination of providing an exercise apparatus for optimizing constant stress on muscles and the cardiovascular system during the complete exercise cycle, i.e., while the glove is in both mediums air and water, makes it desirable to incorporate weights with a swimming glove. The conventional swimming glove stresses muscles only while the glove is in water. The muscles are left unstressed while in air. This stressed/unstressed cycle is undesirable. A constant intense stress on muscles is sought during exercise for optimal building of muscle strength and aerobic capacity, thereby ensuring optimal efficiency of exercise time.

The exercise apparatus of the present invention operates to stress muscles in both mediums: water and air. After the muscles are exercised in water, where the webbing increases the hand surface area in contact with the inertial force of water, the arm leaves the water and enters the less dense medium of air, where the webbing serves no purpose. At this point, the weights begin their function of stressing the muscles at each point in the arm's 180° motion through air. This stress force perpetuates the muscle exercise initiated in water, thereby promoting constant stress on the muscles throughout the arm's 360° arm motion.

An embodiment of the present invention as applied to swimming, even without webbing, is beneficial in consistently stressing muscle groups, as the surface area of the hand alone creates a certain degree of resistance in water.

The material used in the exercise apparatus of the present invention is a durable flexible rubber/fabric mesh. By employing a water repellant Spandex® material which absorbs a minimal amount of water, the exercise apparatus of the present invention will retain no more water than within a glove constructed of a conventional waterproof material. There is no variability in the weight of the present apparatus caused by retention of undesired water within the glove.

The webbing of the present invention may be constructed of Goretex®, which neither permits water to pass through nor permits its surface area in contact with the oncoming water pressure to be altered. In this way, the surface area of the webbing is kept maximal and constant, eliminating unnecessary variables previously beyond the swimmer's control. The webbing increases the swimmer's traction in water and permits greater speed in swimming as well as greater muscle exercise, particularly of the biceps, triceps, pectoralis major and latissimus dorsi.

DETAILED DESCRIPTION OF THE PREFERRED EMBODIMENTS

Figure 1:
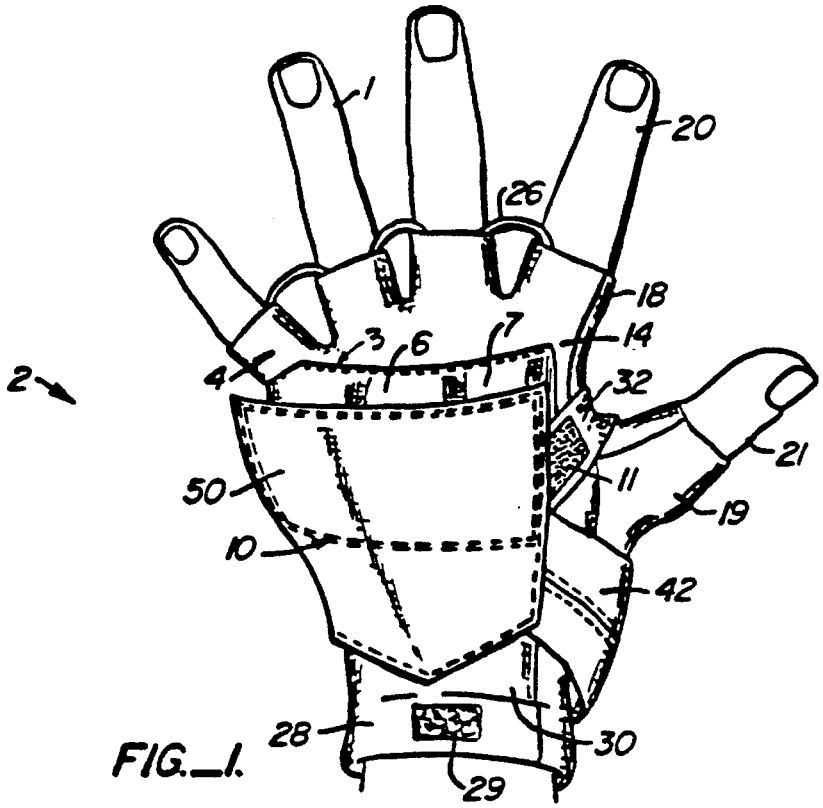
FIG. 1 is a backhand perspective view of a first embodiment of the present invention shown on a user's hand.

Referring now to the drawings, FIGS. 1–14 illustrate various embodiments of exercise apparatus 2 constructed in accordance with the present invention. Each of the drawings illustrates a left hand apparatus of the invention. It is to be understood that the present invention is generally used in pairs, having a left hand apparatus and a right hand apparatus. The right hand apparatus is a mirror image of the various embodiments shown in the drawings.

An exercise apparatus 2 comprises a support 3 having an insert pocket 6 for receiving a removable weight 8. A strap 10 overlies pocket 6 and securely holds weight 8 within the pocket. Strap 10 includes Velcro® strips 12 on the underside 9 of strap 10. Velcro® strips 13 are mounted to the outer surface 7 of pocket 6 for firmly retaining support 3 and entire exercise apparatus 2 to the user's backhand.

Referring now to the embodiment shown in FIGS. 1–4, support 3 is in the form of a mitt 4 and includes a backhand portion 14 and palm portion 16. Finger sleeves 18 for receiving the user's fingers 20 are formed integrally with mitt 4, between backhand portion 14 and palm portion 16. It is noted that while the embodiment illustrated in FIGS. 1–4 includes a thumb sleeve 19, the thumb sleeve is not necessary to practice the present invention.

A plurality of pockets 6 are juxtaposed and mounted to backhand portion 14 of mitt 4 for placement of exercise apparatus 2 on the back of the metacarpal area of the user's hand. Pockets 6 are aligned parallel to finger sleeves 18. Weights 8 may be inserted into or removed from pockets 6 through opening 17. Therefore, as weights 8 are inserted into pockets 6, they assume an orientation parallel to the user's fingers 20. This orientation optimizes muscle group movement, minimizes restriction of blood flow, and also permits weights 8 to conform to the natural curvature of the back of the hand. Velcro® strips 13, mounted to an outer surface 7 of pockets 6, are parallel to each other and to finger sleeves 18.

Figure 3:
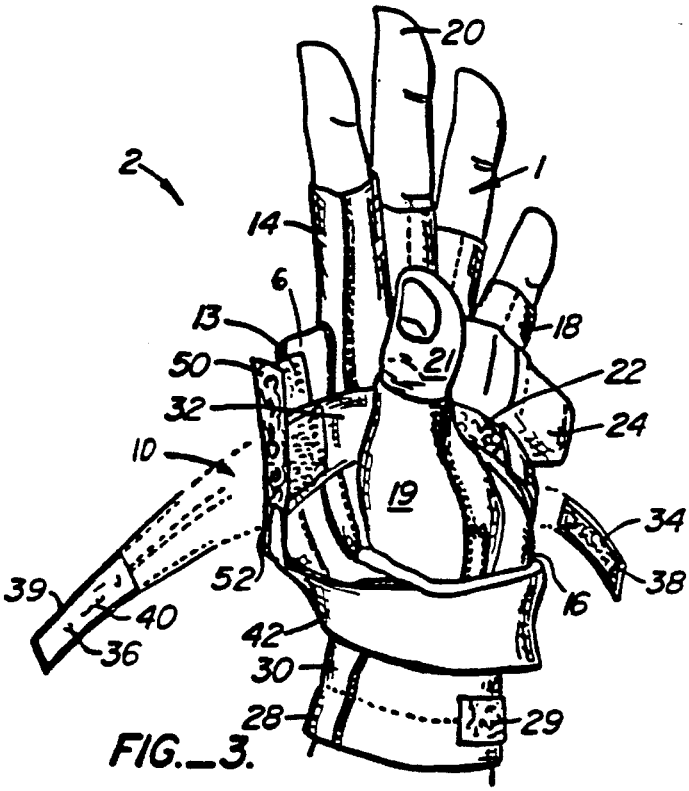
FIG. 3 is a side palm perspective view of the invention as shown in FIG. 1.

Palm portion 16 of mitt 4, as seen in FIG. 3, includes a Velcro® strip 22, for securing strap 10 in place and preventing lateral movement of weights 8. Palm pocket 24 is mounted in the upper region of palm portion 16 for receiving a palm weight. The user may conform his fingers about the palm weight because it may be comfortable to do so while running, or during other activities. A wrist belt 28 is disposed at the lower end 30 of mitt 4 and includes Velcro® fasteners (not shown) for securing exercise apparatus 2 on the user's hand 1.

Strap 10 is removably mounted across pockets 6 by Velcro® strips 12, 13 to overly and retain weights 8 in place on the back of the metacarpal area of the user's hand, as seen in FIG. 1. Strap 10 includes a first band 32 having first and second free ends 34, 36 extending around the user's palm for securing strap 10 in place and preventing lateral or perpendicular movement of weights 8. First free end 34 wraps around the metacarpal bone of the little finger. Second free end 36 wraps between the metacarpal bones of the index finger and thumb.

An auxiliary band 42 extends at an angle of approximately 45° from first band 32, downwardly away from finger sleeves 18 toward the user's wrist. An end 44 of auxiliary band 42 is secured to first band 32 along its midsection, toward one side of Velcro® strip 12 closer to the little finger. A patch 50 is attached to an end 45 of auxiliary band 42, opposite end 44. Auxiliary band 42 extends across backhand portion 14 downwardly away from fingers 20, and encircles the inside of the user's wrist, then below thumb 21, such that patch 50 can be secured to first band 32 across the metacarpal area of the backhand. The large configuration of patch 50 allows for maximal adjustment of exercise apparatus 2, as well as to fasten patch 50 simultaneously to both Velcro® strips 11, 13.

A pad 46 is positioned in a pad pocket 48 on underside 9 of auxiliary band 42 at a location resting on the user's wrist. Pad 46 ensures maximum comfort by decreasing the force pressure operating against the palmaris longus tendon of the user's wrist.

Free ends 34, 36 converge at palm portion 16 and are secured together by Velcro® strips 38, 39. Velcro® strip 38 is disposed on underside 9 at first free end 34. Velcro® strip 39 is disposed on free end 36 on the outer surface of strap 10 for mating with Velcro® strip 38. In the embodiment of strap 10 shown in FIG. 4, second free end 36 is wrapped around the user's hand prior to wrapping first free end 34. A Velcro® strip 40 is disposed on underside 9 of free end 36 for mating with Velcro® strip 22 of palm portion 16. Patch 50 includes Velcro® 52 mounted on underside 9. When auxiliary band 42 is wrapped around the user's wrist, Velcro® 52 mates with Velcro® strips 13 on outer surface 7 of pockets 6 and with a Velcro® strip 11 mounted on the outer surface of strap 10, on the surface of first band 32 opposite Velcro® strip 12.

It can be easily understood that first free end 34 could include Velcro® strips on both underside 9 and the outer surface, allowing first free end 34 to be wrapped around the user's hand prior to wrapping second free end 36.

Exercise apparatus 2, as well as each of the preferred embodiments disclosed in this application, is constructed of a durable flexible rubber/fabric mesh. One example of a construction material is a water repellant Spandex® material which absorbs a minimal amount of water. Exercise apparatus 2 constructed of an expandable material will retain no water within support 3. Thus, the weight of exercise apparatus 2, due to retention of undesired water within support 3, does not vary.

Figure 2:
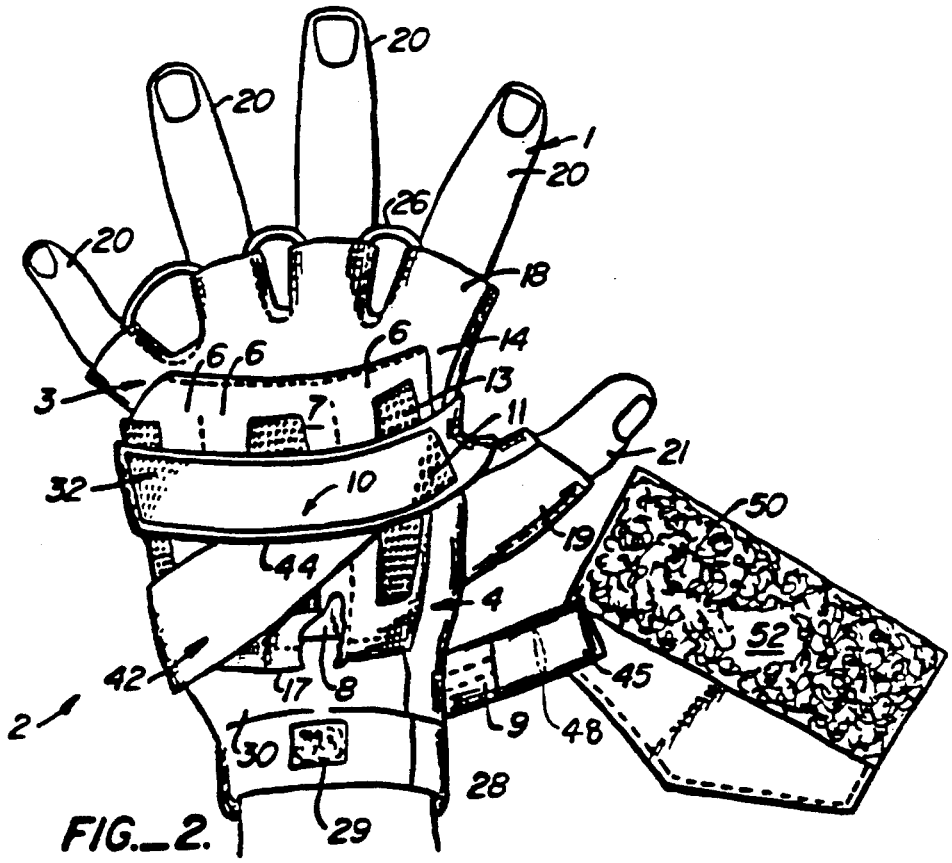
FIG. 2 is a backhand perspective view of the embodiment of FIG. 1 as it is being placed on the user's hand.
Figure 10:
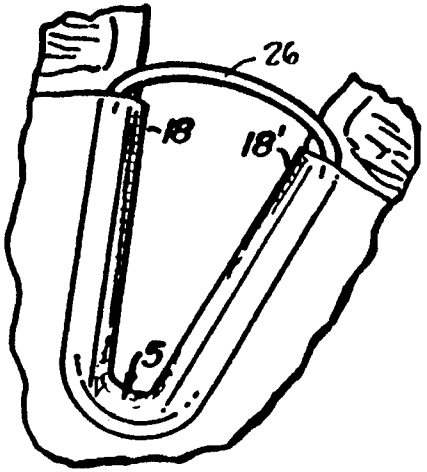
FIG. 10 is a cross sectional view of the loop of the embodiments shown in FIGS. 1 and 6.

As seen in FIGS. 1, 2 and 10, adjacent finger sleeves 18 are connected together by loops 26 for facilitating removal of mitt 4 from the user's hand. As seen in FIG. 10, each loop 26 is continuous, extending into a first finger sleeve 18, through the interior region 5 of mitt 4 between backhand portion 14 and palm portion 16, and into a second finger sleeve 18' adjacent the first finger sleeve. Thus, the upper edge of adjacent finger sleeves 18, 18' includes a portion of loop 26 extending therebetween. While loop 26 is shown in FIG. 10 as being formed of a single continuous material, such construction is not necessary. The loops may also be sewn into the sides of the adjacent finger sleeves or may be attached separately to the glove generally in the vicinity of the metacarpo phalangeal joints of the adjacent finger sleeves. Those skilled in the art will also recognize that other positions and manners of attaching the loops may be employed without interfering with the function of the loops. The loops are formed so that they may receive the fingers of the user's hand and are positioned generally in the vicinity of the proximal phalanges. Formed and arranged in this manner, the loops provide unobtrusive "handles" by which the user may easily pull off the glove.

Figure 11:
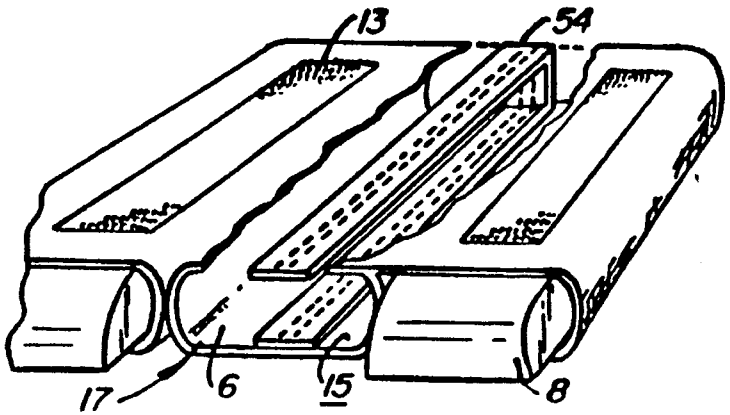
FIG. 11 is a perspective view of the reinforcing strip of each of the embodiments.

Turning now to FIG. 11, a reinforcing strip 54 is affixed to interior surface 15 of pocket 6 for securing weight 8 in place. Reinforcing strip 54 can be seen through opening 17 in pocket 6. Reinforcing strip 54 is a continuous reinforcing element extending along the bottom interior surface of pocket 6 adjacent opening 17, rearwardly (as seen in FIG. 11), around to the upper interior surface of pocket 6 and terminating adjacent the upper interior surface of pocket 6, adjacent opening 17. Reinforcing strip 54 is sewn through interior 15 of pocket 6 and to Velcro® strip 13. In this manner, weight 8 is effectively secured because it is encased by strip 54 which is locked to Velcro® strip 13 which, itself, locks to Velcro® strip 12. Therefore, weight 8 is ultimately secured, through this series of locking mechanisms to the securing strap 10. Reinforcing strip 54, as seen in FIG. 11, is utilized within the interior of the pockets of every form of the invention disclosed herein. However, the pockets of the present invention could be constructed without a reinforcing strip.

The wrist belt 28 includes a Velcro® strip 29, as seen in FIGS. 1–3. An additional wrist weight (not shown), preferably in the form of a bracelet, may be added to exercise apparatus 2. The wrist weight is attached to Velcro® strip 29 by a corresponding Velcro® strip disposed on the wrist weight. A wrist weight may be adapted for any of the embodiments disclosed in this application.

Use of exercise apparatus 2 will now be described. The desired amount of weight 8 is placed in insert pockets 6 and palm pocket 24.

The user inserts hand 1 into mitt 4 as one would put on a glove. Fingers 20 are located within respective finger sleeves 18. Thumb 21 is located within thumb sleeve 19. Velcro® fasteners (not shown) positioned on wrist belt 28 are attached together.

Strap 10 is then fastened to mitt 4 for securing weights 8 in their proper position. Velcro® strip 12 on first band 32 is affixed to Velcro® strip 13 on pocket 6 of backhand portion 14. Second free end 36 is extended to wrap between the metacarpal bones of the user's index finger and thumb. Velcro® strip 40 on underside 9 of second free end 36 is affixed to Velcro® strip 22 on palm portion 16. Velcro® strip 39 disposed on the outer surface of second free end 36 is exposed for mating with first free end 34. First free end 34 is extended to wrap around the metacarpal bone of the user's little finger such that Velcro® strip 38 is affixed to Velcro® strip 39. Weights 8 are thereby secured against lateral movement across the back of the user's hand or perpendicular movement away from the user's hand.

Auxiliary band 42 is extended across backhand portion 14, from its position offset to one side closer to the user's little finger. Auxiliary band 42 is wrapped toward the metacarpal bone of the user's little finger and around the inside of the user's wrist. Pad 46, which generally remains stored within pad pocket 48, is positioned about the user's wrist for maximum comfort and to ease pressure on the palmaris longus tendon of the wrist. As end 45 of auxiliary band 42 encircles the user's wrist near thumb 21, patch 50 is brought upwardly around the opponens pollicis muscle of the user's thumb 21 such that Velcro® 52 is fastened to Velcro® strips 11 and 13. First band 32 prevents lateral movement of weights 8. Auxiliary band 42 prevents movement of weights 8 against gravity. In this way, weights 8 are securely fastened to the metacarpus area of the back of the user's hand in both the lateral and gravitational directions.

If desired, the wrist weight (not shown) may then be attached to exercise apparatus 2 by Velcro® at strip 29.

In order to remove exercise apparatus 2 from the user's hand, strap 10 is loosened in reverse manner to that of fastening. The present invention includes an apparatus for facilitating removal of mitt 4 from hand 1. The user inserts the fingers of the opposite hand into loops 26 on the exterior of mitt 4. The user extends each of fingers 20 in mitt 4 to its unbent configuration, then pulls loops 26 with the fingers of the opposite hand. Because loops 26 extend to interior 5 of adjacent finger sleeves 18, 18', mitt 4 is easily removed from hand 1 by pulling on the loops.

Figure 5:
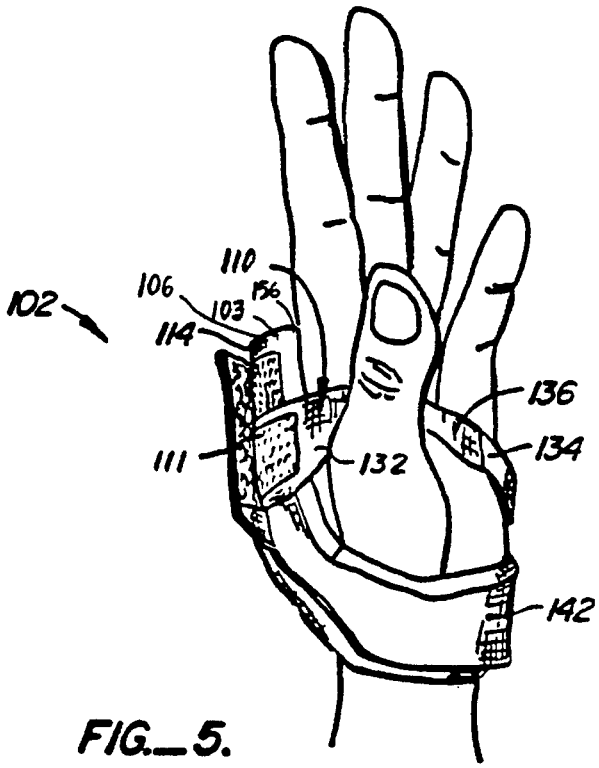
FIG. 5 is a side palm perspective view of a second embodiment of the invention.

FIG. 5 discloses a modified form 102 of exercise apparatus. Like reference numerals correspond to reference numerals of the embodiment of FIGS. 1–3 incrementally increased by 100. Support 103 is in the form of backhand portion 114 and includes a first surface 156. Insert pockets 106 are mounted to first surface 156 for receiving removable weight 8.

The embodiment shown in FIG. 5 differs from the embodiment shown in FIGS. 1–3 in that support 103 of the embodiment of FIG. 5 does not include a mitt having a backhand portion 14 and a palm portion 16. Rather, as discussed above, support 103 includes only a backhand portion 114 having pockets 106 formed on a first surface 156. In use, support 103 is attached directly to the user's hand 1, positioning weights 8 on the metacarpal area on the back of the user's hand, as described with reference to exercise apparatus 2.

Figure 4:
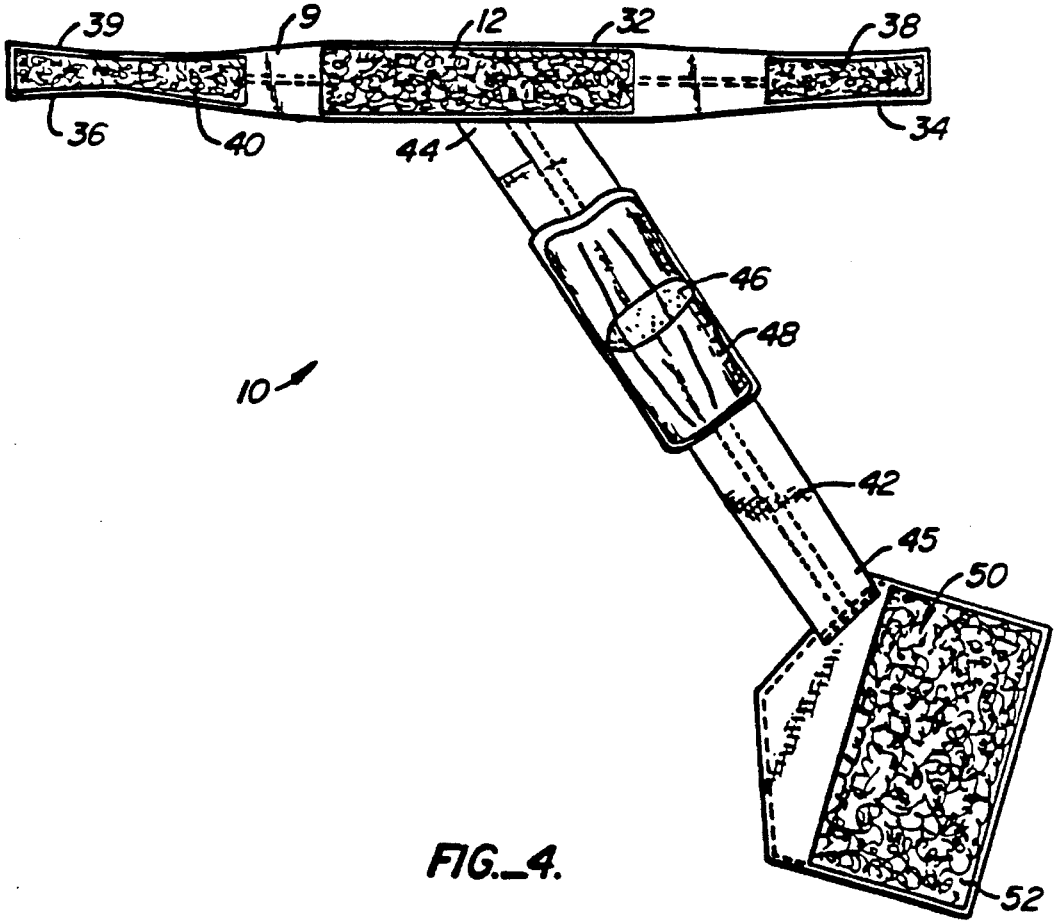
FIG. 4 is an underside view of the strap as shown in FIGS. 1–3 and in the embodiment of FIG. 5.

The strap 110 employed with the embodiment of FIG. 5 is substantially identical to strap 10 as seen in FIG. 4. Strap 110 overlies pocket 106, is attached to backhand portion 114, extends around support 103 to a location on the opposite side of support 103 as first surface 156, and securely retains weight 8 within pocket 106. However, second free end 136 of strap 110 need not include a Velcro® strip on underside 109 of strap 110 corresponding to Velcro® strip 40 because exercise apparatus 102 does not include a portion corresponding to palm portion 16 of exercise apparatus 2 to which the Velcro® strip would be attached.

As in all embodiments disclosed herein, exercise apparatus 102 includes a reinforcing strip 154 as seen in FIG. 11. Because exercise apparatus 102 does not include a mitt portion, loops (See FIG. 10) are not employed in the embodiment of the invention seen in FIG. 5. Additionally, a wrist weight is generally not incorporated in the embodiment of FIG. 5.

Figure 6:
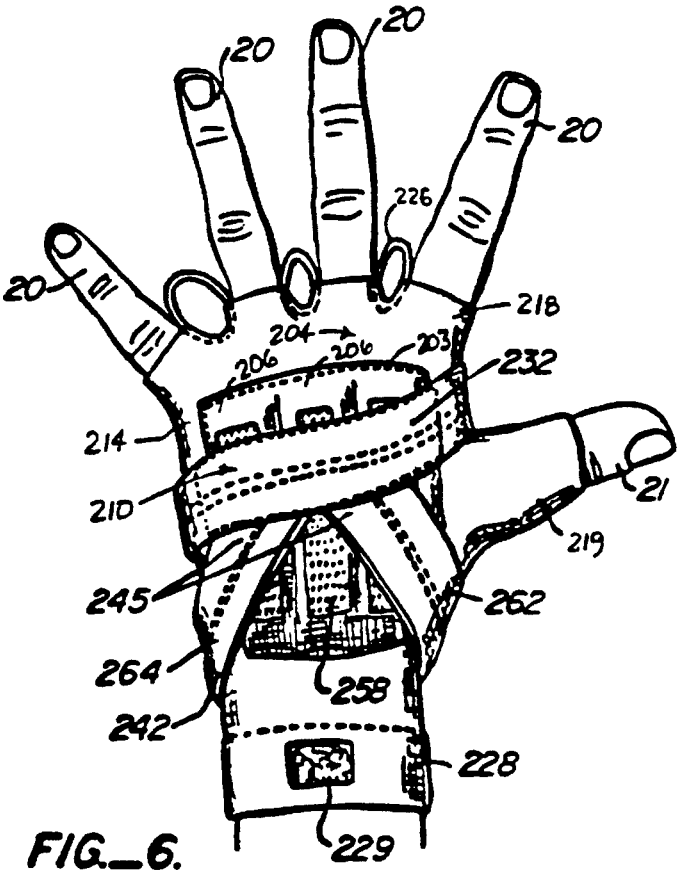
FIG. 6 is a backhand perspective view of a third embodiment of the present invention as shown on the user's hand.
Figure 7:
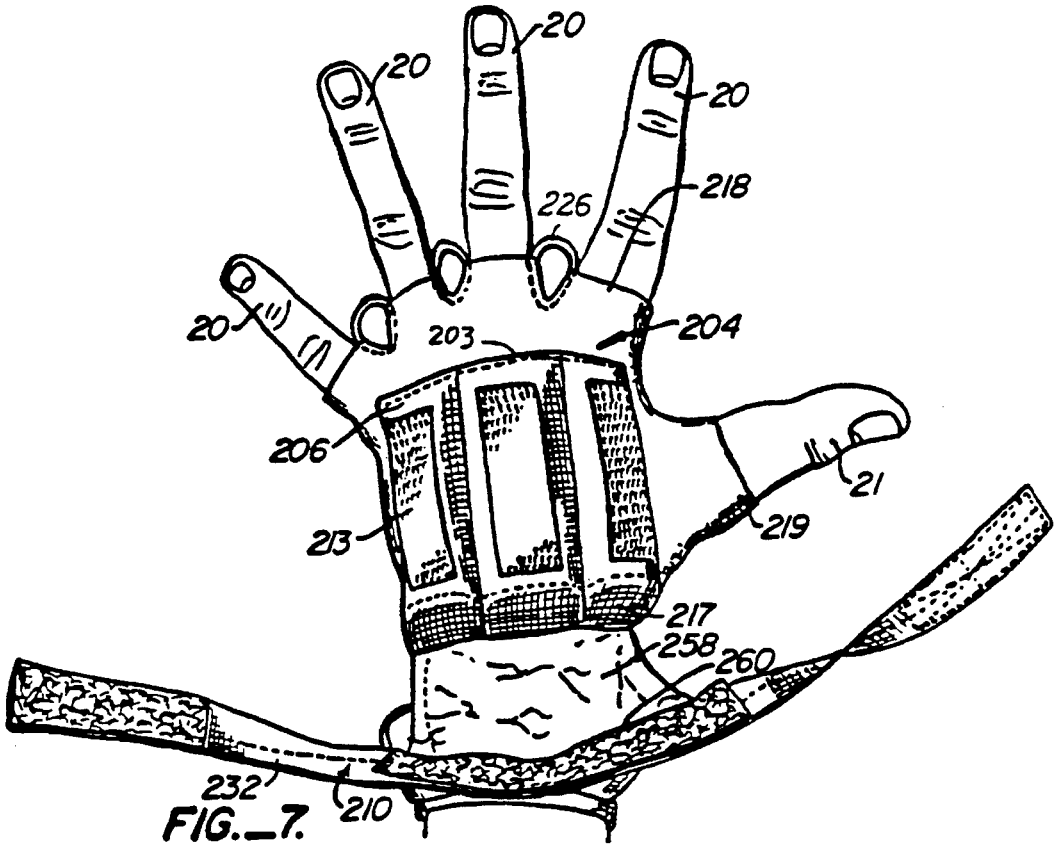
FIG. 7 is an backhand perspective view of the embodiment as shown in FIG. 6 on the user's hand in the unfastened position.
Figure 8:
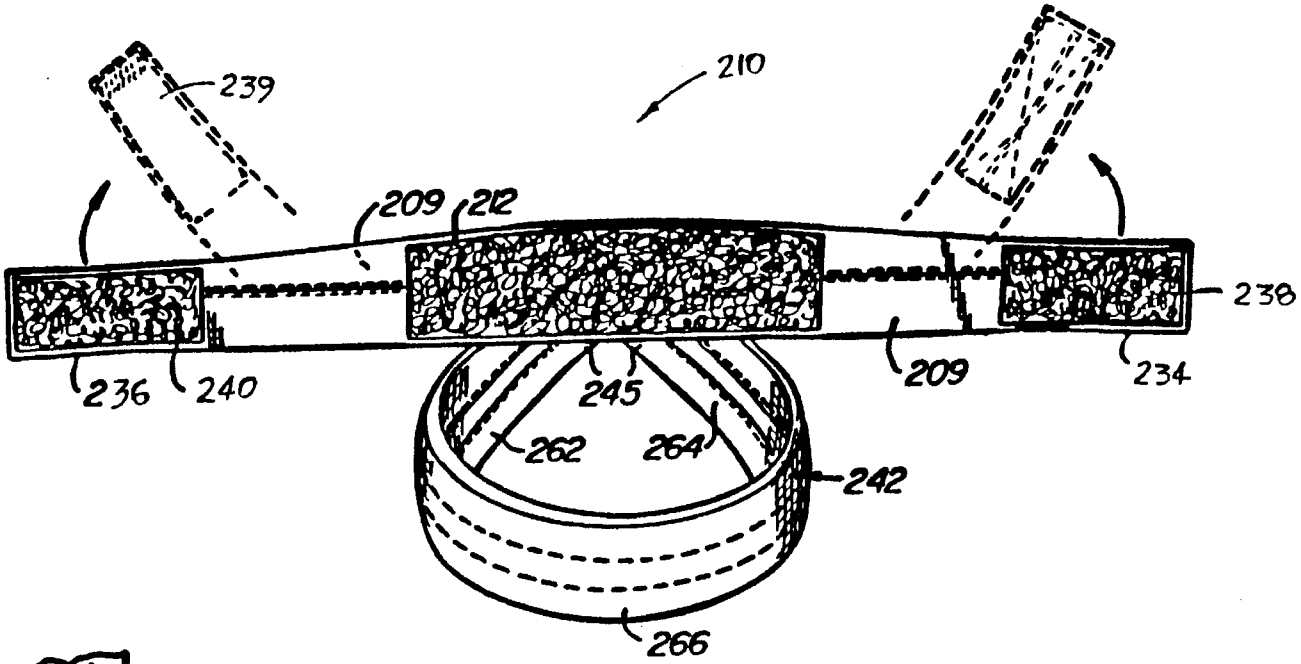
FIG. 8 is an underside view of the strap as shown in FIG. 6 and in the embodiment of FIG. 9.

FIGS. 6–8 disclose a modified form 202 of exercise apparatus. Like reference numerals correspond to reference numerals of the embodiment of FIGS. 1–3 incrementally increased by 200. The embodiment disclosed in FIGS. 6–8 is particularly beneficial for use during swimming.

As shown in FIGS. 6 and 7, support 203 is in the form of a mitt 204 having a backhand surface 214 and a palm surface 216. Insert pockets 206 are mounted to backhand portion 216 for receiving a removable weight 8. The embodiment shown in FIGS. 6 and 7 is similar to mitt 4 of the embodiment of FIGS. 1–3. However, the embodiment shown in FIGS. 6–8 does not include a patch which may be susceptible to water pressure exerted beneath it for undesired release of the Velcro® fasteners.

The embodiment shown in FIGS. 6–8 differs from the embodiment shown in FIGS. 1–3 in that strap 210 is permanently secured to support 203. Mitt 204 includes a flap 258 for closing pockets 206 containing weights 8. Flap 258 is attached to backhand portion 214 between opening 217 and wrist belt 228. In the open position of flap 258, a remote edge 260 of the flap is suspended toward the user's wrist as seen most clearly in FIG. 7. Strap 210 is attached to flap 258 along remote edge 260. Velcro® strip 212 adjoins remote edge 260 for fastening Velcro® strip 212 to Velcro® strips 213. When Velcro® strips 212, 213 are fastened together, flap 258 is retained across the back of the metacarpal area of the user's hand, closing pockets 206.

Strap 210 includes a first band 232 having first and second free ends 234, 236, as described with reference to first and second free ends 34, 36 of FIGS. 1–4. First and second free ends 234, 236 include Velcro®, as described above, for securing in mating position on palm portion 216.

An auxiliary band 242 includes two ends 245, both permanently secured to first band 232. Ends 245 extend symmetrically from first band 232, each at an angle of approximately 45°, downwardly away from finger sleeves 218 toward wrist belt 228. Auxiliary band 242 extends symmetrically across backhand portion 214, one branch 262 extending about the opponens pollicis muscle of the user's thumb 21; the other branch 264 extending about the abductor digiti quinti muscle at the little finger. Branches 262, 264 unite at union 266 as seen in FIG. 8, encircling the user's wrist. For illustration of union 266 positioned on the user's wrist, refer to the embodiment of FIG. 9, described below.

Strap 210 is specifically designed to maximize laminar water flow by eliminating a patch as seen in the embodiment of FIGS. 1–4. A patch such as patch 50 would peel back in water due to the flow of water against the patch, thereby exposing the patch, increasing water drag and resistance in a manner that is unpredictable and therefore, becomes a hinderance.

The embodiment shown in FIGS. 6–8 includes the feature of loops 262, as seen in FIG. 10, as well as reinforcing strips 254, as seen in FIG. 11. Additionally, a wrist weight may be attached to Velcro® strip 229.

In use, the user inserts hand 1 into mitt 204, as described with reference to the embodiment of FIGS. 1–3. Flap 258 is arranged to overlie pockets 206 and, thereby, close opening 217. Velcro® strip 212 on underside 209 of first band 232 is fastened to Velcro® strips 213 on backhand portion 214 of mitt 204. First and second free ends 234, 236 are then fastened together at palm portion 216, as described with reference to the embodiment of FIGS. 1–5. Exercise apparatus 202 is, thus secured to the user's hand. Removal of mitt 204 is facilitated by loops 226.

Figure 9:
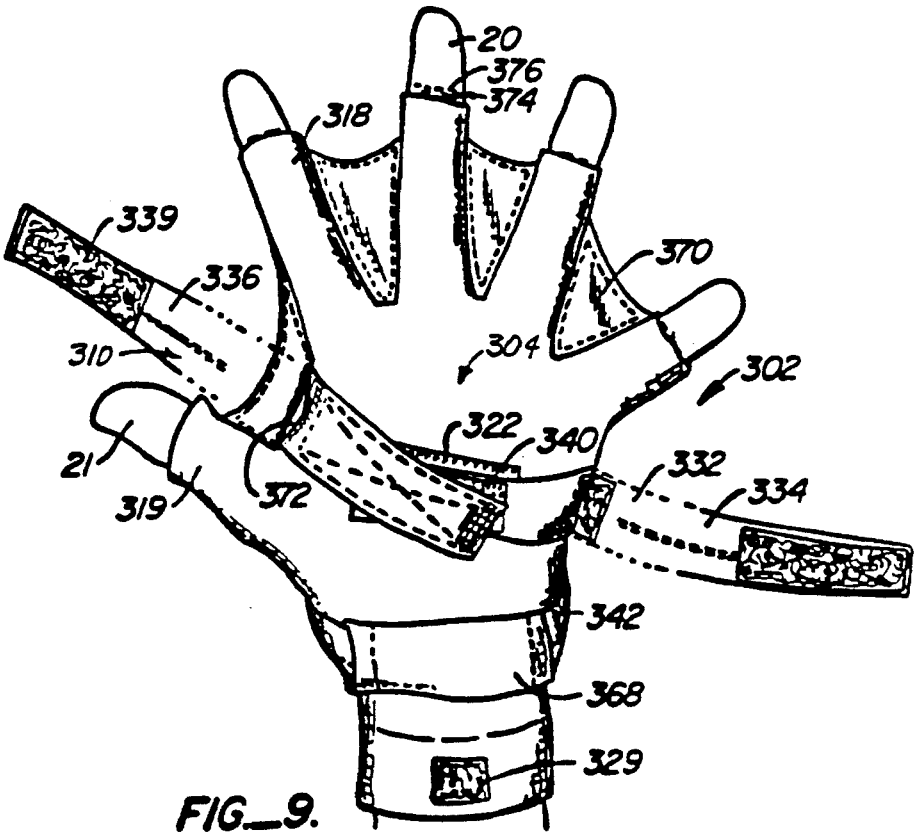
FIG. 9 is a palm perspective view of a fourth embodiment of the present invention as shown on the user's hand.

FIG. 9 discloses a modified form 302 of exercise apparatus. Like reference numerals correspond to reference numerals of the embodiment of FIGS. 1–3 incrementally increased by 300. The embodiment disclosed in FIG. 9 is similar to exercise apparatus 202, as seen in FIGS. 6–8. As in exercise apparatus 202 shown in FIGS. 6–8, the embodiment illustrated in FIG. 9 is also particularly beneficial for use during swimming.

Strap 310 of FIG. 9 is identical to strap 210 shown in FIG. 8. Branches 362, 364 encircle the user's wrist, uniting at union 366 and fitting within a sleeve 368. It should be noted that strap 210 of exercise apparatus 202 is identical to strap 310, also including a sleeve (not shown in FIGS. 6 and 7).

The embodiment shown in FIG. 9 differs from exercise apparatus 202 (shown in FIGS. 6–8) only in that adjacent fingers 18 are connected together by webbing 370, rather than loops 226. Webbing 370 increases resistance to the water, thus improving efficiency and speed of the swimmer.

As seen in FIG. 9, second free end 336 of first band 332 slips through a slot 372 positioned at the intersection of index finger sleeve 18 and thumb sleeve 19. In this way, second free end 336 wraps between the metacarpal bones of the index finger and thumb, as does the second free end of each of first bands 32, 132, 232.

The precise positioning of webbing 370 additionally improves efficiency and speed of the swimmer. Webbing 370, extending only to the proximal ends 374 of the distal phalanges 376, ensures that all physical stress is limited to the forearm, upper arm, shoulder and back.

The webbing of the present invention is constructed of Goretex®, which neither permits water to pass through nor permits its surface area in contact with the oncoming water pressure to be altered. In this way, the surface area of the webbing is kept maximal and constant, eliminating unnecessary variables previously beyond the swimmer's control.

In use, exercise apparatus 302 operates substantially identically to that of exercise apparatus 202. However, strap 310 of exercise apparatus 302 differs from strap 210 only in that strap 310 slips through slot 372 between finger sleeve 318 and thumb sleeve 319. Additionally, adjacent finger sleeves 318 are connected via webbing 370 (See FIG. 9) rather than loops.

Figure 12:
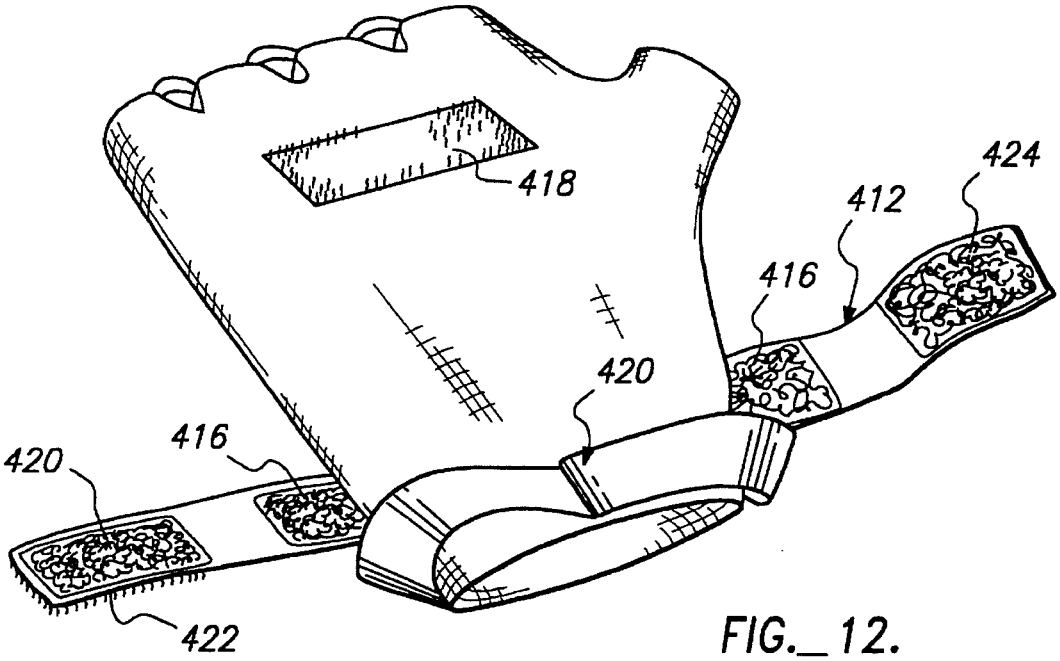
FIG. 12 is a perspective view of the palm side of an alternative embodiment of the invention.
Figure 13:
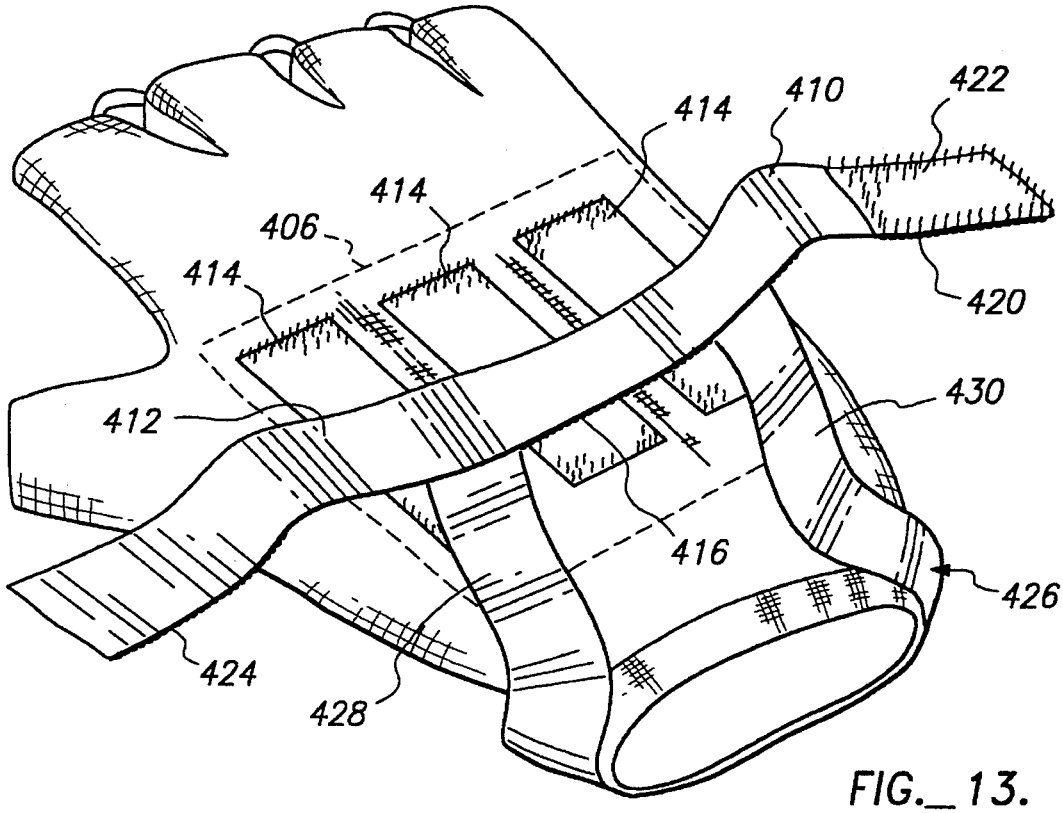
FIG. 13 is a perspective view of the backhand side of the embodiment of FIG. 12.
Figure 14:
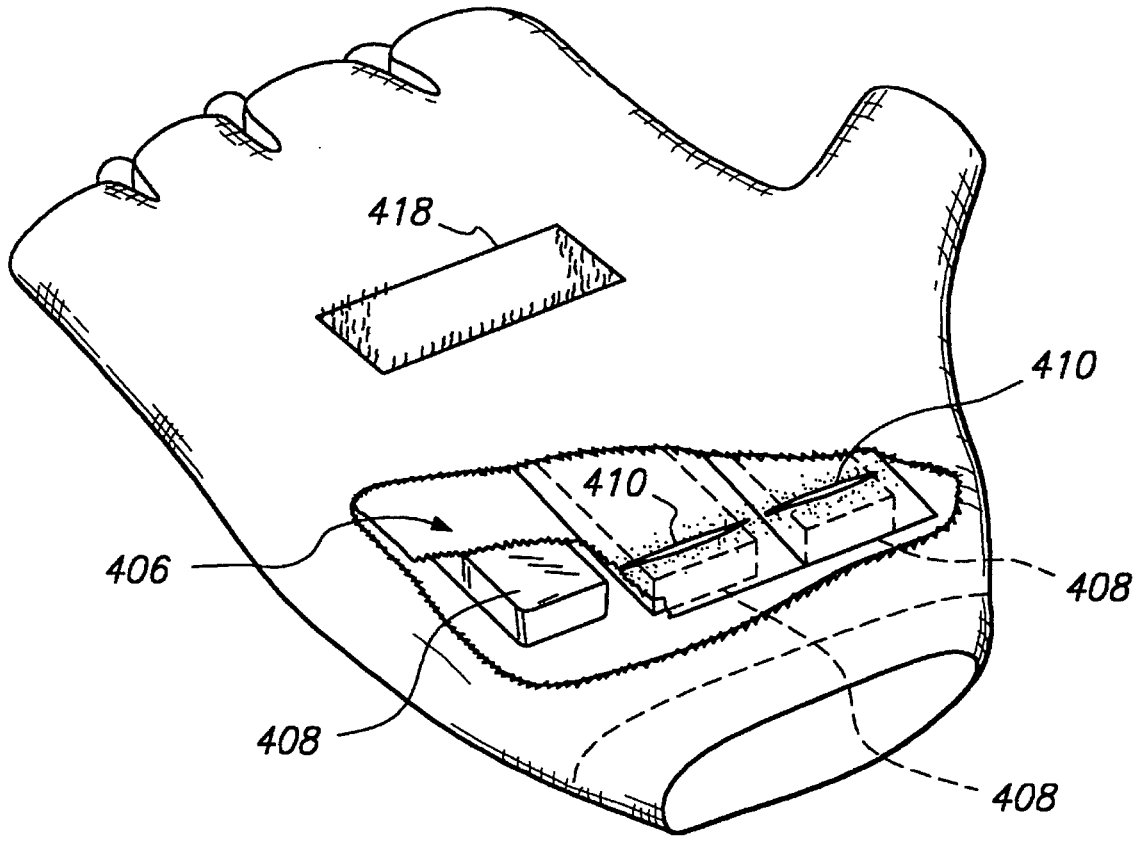
FIG. 14 is a cut-away perspective view of the palm side of the embodiment of FIG. 12 (with the strap removed) showing the weight pocket.

An alternative embodiment of an exercise glove according to the invention is shown in FIGS. 12–14 in which the weight pocket is accessible from the inside of the glove mitt. As before, the glove has a mitt, which is generally form fitting to the user's hand, composed of a palm portion visible in FIG. 12 and a backhand portion visible in FIG. 13. Integrally formed with the mitt is a plurality of finger sleeves generally form fitting to the user's fingers. In FIGS. 12–14 the finger sleeves extend to about the midregion of the proximal phalanges of the user's hand, they could extend longer. The backhand portion is formed to include a pocket 406 for receiving a weight. As illustrated in FIG. 13, pocket 406 includes three separate sections for receiving three separate weights 408, although a single weight may also be used. As seen in the cut-away view of FIG. 14, pocket 406 opens to the interior of the mitt. The material defining the inner face of the pocket against the user's backhand includes three slits 410 through which weights 408 may be inserted into pocket 406.

If the mitt is formed to fit the user's hand snugly, that is, to fit closely or to form fit the user's hand, then the mitt itself will tend to hold the weight in position against the back of the hand during exercise. The holding action, and the comfort to the user, are enhanced if the mitt is formed of a stretchable material. For light weights and light exercise, this may be sufficient to maintain the weight in position. For more sureness this embodiment may also be provided with a strap 412 over the weight pocket to hold the weights securely against the hand.

To hold strap 412 in position over the weight pocket, the backhand portion includes a first hook and loop fastener portion 414 overlying the pocket, and strap 412 includes a second hook and loop fastener portion 416 of opposite character over said pocket disposed to connect with the fastener portion 414. Strap 412 extends around the mitt to the palm portion where it attaches to itself and to the palm portion. For this purpose the palm portion carries hook and loop fastener portion 418, and one end of strap 412 includes mating hook and loop fastener portion 420. The opposite ends of strap 412 also carry further hook and loop fastener portions 422 and 424 connecting to one another to fasten the strap ends securely to each other.

Strap 412 holds the weight securely against relative movement transverse to the user's hand during exercise. An auxiliary strap 426 may also be employed for extra security in holding the weight against relative longitudinal movement outward along the axis of the user's hand. As illustrated in FIG. 12, strap 426 is connected to the exercise glove at the midregion indicated at reference numeral 428 on the palm side, although the auxiliary strap may also be wrapped around the wrist or attached at other locations. Auxiliary strap 426 includes first and second arms 428 and 430 extending around opposite sides of the user's hand to the backhand portion, the arms being connected to strap 412 generally over pocket 406. Auxiliary strap 426 serves to exert a tension on the main strap 412 in the direction along the user's arm, which serves to hold the weight fixed in position during exercise movements in which the arm, and consequently weight 408, are thrown forward or simply dropped to the user's side.

This invention has been described with reference to the illustrated embodiments. Given the benefit of this disclosure, those skilled in the art will recognize that variations and modifications can be made without departing from the scope of the invention delimited in the appended claims. For example, pockets for carrying personal articles such as keys or money may be incorporated into the exercise glove. Additionally, a palm weight may be incorporated into any embodiment. Thus, the invention is not intended to be limited only to the embodiments illustrated here, but is defined by the following claims.

What is claimed is:

1. An exercise glove for use in swimming comprising:

a mitt having a backhand portion, a palm portion and being constructed substantially of elastic materials resistant to deterioration in saltwater environments, said backhand portion having an external side facing away from the palm portion and an internal side facing towards the palm portion;

a plurality of finger sleeves for receiving the fingers of a user, each said finger sleeve having a proximal end connected to the mitt and an open distal end extending away from the mitt and configured to allow a finger to extend through the distal end when the mitt is worn;

a webbing disposed between at least two of said finger sleeves extending from said mitt to a point near the proximal ends of each said two finger sleeves; and a plurality of pockets, each said pocket configured to receive a weight, said pockets being disposed upon the internal side of the backhand portion.

2. The exercise glove as defined by claim 1 wherein said webbing terminates at the distal ends of said two finger sleeves.

3. The exercise glove as defined by claim 1 wherein said elastic materials include closed-cell neoprene.

4. The exercise glove as defined by claim 1, further comprising a strap mounted across the external side of said pockets.

5. The exercise glove as defined by claim 4 wherein said plurality of finger sleeves includes a thumb sleeve and an adjacent finger sleeve, and said webbing includes a slotted web portion extending between said thumb sleeve and adjacent finger sleeve and formed with a slot for receiving said strap.

6. The exercise glove as defined by claim 1 wherein said pocket is formed to open to the exterior of said mitt.

7. The exercise glove as defined by claim 1 wherein said pockets are formed to open into the interior of said mitt.

8. The exercise glove of claim 1 further comprising a thumb sleeve connected to the mitt and configured to receive a thumb of a user.

9. The exercise glove of claim 1 wherein the thumb sleeve includes a distal end, the distal end of the thumb sleeve being closed.

* * * * *